United States Patent [19]

Tomoyoshi

[11] 4,075,594

[45] Feb. 21, 1978

[54] THERMOSTAT WITH RESET ARM

[75] Inventor: Uchiya Tomoyoshi, Misato, Japan

[73] Assignee: Uchiya Co., Ltd., Misato, Japan

[21] Appl. No.: 714,400

[22] Filed: Aug. 16, 1976

[30] Foreign Application Priority Data

Aug. 15, 1975 Japan ..... 50-112946[U]

[51] Int. Cl.[2] ..... H01H 37/54

[52] U.S. Cl. ..... 337/348; 337/91; 337/358

[58] Field of Search ..... 337/16, 36, 37, 52, 337/55, 56, 70, 72, 75, 85, 89, 91, 98, 333, 334, 342, 343, 348, 356, 358, 359, 362, 365, 367

[56] References Cited

U.S. PATENT DOCUMENTS

| | | | |
|---|---|---|---|
| 2,262,205 | 11/1941 | Schachtner | 337/89 X |
| 2,590,605 | 3/1952 | Godsey | 337/16 |

FOREIGN PATENT DOCUMENTS

| | | | |
|---|---|---|---|
| 244,700 | 5/1947 | Switzerland | 337/52 |

*Primary Examiner*—A. D. Pellinen
*Attorney, Agent, or Firm*—George B. Oujevolk

[57] ABSTRACT

A thermostat comprises a mechanism for opening and closing contacts by a self-resetting bimetal and the mechanism also includes a reset arm for holding a contact arm in open-circuit position with the contacts kept apart. The thermostat in this holding condition can be reset by hand.

1 Claim, 9 Drawing Figures

THERMOSTAT WITH RESET ARM

This invention relates to a thermostat which can automatically hold its associated contacts open and can be released from the holding condition by manual operation.

The hand-resetting thermostats heretofore in use are roughly divided into two types; one uses as a heat sensing element a non-resetting bimetallic strip capable of keeping its shape as bent backward in response to a temperature change, and the other employs a self-resetting bimetallic sensing element in combination with a cam- or solenoid-operated mechanism which holds the element in the bent position.

The former is disadvantageous because the inherent properties of the non-resetting bimetallic strip limit the temperature setting within a very narrow range and, moreover, the mechanical force used to push the bent bimetallic element back to the original position tends to change the preset temperature range, too. The latter also has drawbacks of complex construction, large size, and high cost due to the incorporation of the cam- or solenoid-operated mechanism.

As is well known, the thermostat is a device that opens or closes the associated contacts and hence the circuit by the bending of a bimetallic sensing element with an increase in ambient temperature. Modified arrangements are also in use including circuit breakers wherein a bimetallic element bends rearward on heat development in itself with the current that flowed through the circuit it made.

Such circuit breakers, usually constructed to hold the bimetallic element in the backwardly bent position by means of a solenoid-actuated cam mechanism, are so large in size that they have not been conveniently employed other than being mounted in switchboards or the like.

It is an object of the present invention to provide a thermostat which can automatically hold the contacts open and be reset from the open condition by hand.

Another object of the invention is to provide a thermostat which uses a self-resetting bimetallic strip as a sensing element and has a wide temperature setting range.

Still another object of the invention is to provide a thermostat using as a sensing element a heat-sensitive bimetallic strip which senses and acts in response to an excessive increase in ambient temperature.

A further object of the invention is to provide a thermostat which employs an overcurrent-sensitive bimetallic element which acts upon heat development with an abnormal current flowing through the contacts.

These and other objects and advantages of the invention will be more fully understood from the following description taken in conjunction with the accompanying drawings showing embodiments thereof. In the drawings.

Figure 1:
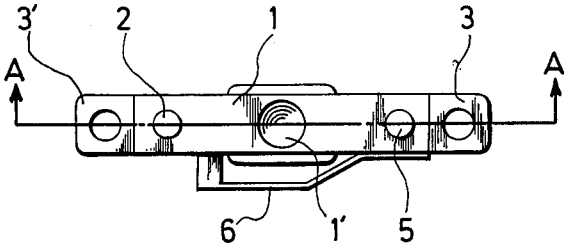
FIG. 1 is a top plan view of an embodiment of thermostat of the invention.
Figure 2:
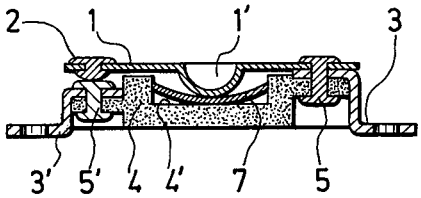
FIG. 2 is a sectional view taken along the line A—A of FIG. 1.
Figure 3:
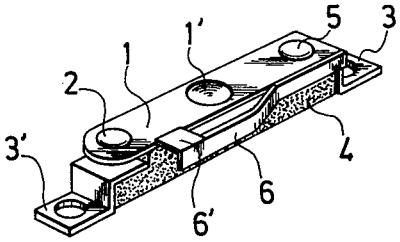
FIG. 3 is a perspective view of the thermostat shown in FIG. 1.

Referring now to FIGS. 1 to 3, there is shown a thermostat of the heat-control type according to the invention which functions upon an excessive increase in ambient temperature. The numeral 1 indicates an elastic contact arm carrying a contact 2 at its free end, the opposite end of which being rigidly secured, together with a terminal 3 in electrical contact therewith, to one end of a support frame 4 of insulating material by a clamp 5. Also, a downwardly protruding semispherical dent 1' is formed in the middle of the arm 1. To the other end of the support frame 4 is fixed another terminal 3' by a clamp 5' in electrical contact with the contact 2. A reset arm 6 of an elastic metal such as phosphor bronze is secured at one end to either one side of the contact arm 1 or a suitable portion of the insulating support frame 4. The elasticity of the reset arm 6 permits its inverted-U-shaped free end 6' to bear against the same side of the arm 1. Between the arm 1 and a recess 4' of the support frame 4 is disposed an arcuate bimetallic strip 7, which is adapted to move upward or bend backward when the ambient temperature rises excessively. This bimetallic strip 7 is securely anchored at both ends in the opposite walls of the recess 4', and is positioned so that its middle portion faces the bottom of the dent 1'.

With the construction described, the thermostat according to the invention operates in the following way. As an apparatus to be protected undergoes an abnormal temperature rise, the bimetallic strip 7 moves upward until its arc is reversed, forcing up the dent 1' and therefore the contact arm 1, too. Consequently, the contact 2 is raised away from the clamp 5' serving as the mating contact while, at the same time, the inverted-U-shaped free end 6' of the reset arm 6 is forced, by virtue of the arm's own elasticity, into the space now left open under the contact arm 1. Thus, even after the bimetallic element 7 has returned to the original position, the contact arm 1 is kept from descending by the reset arm 6 and hence the contact 2 remains in the off position.

When resetting the thermostat after the apparatus in which it is mounted has been inspected and repaired, the operator pulls out the free end 6' of the reset arm 6 from the space below the contact arm 1 with tweezers or the like, thus allowing the contact 2 of the arm 1 to reestablish the contact with the clamp 5'. The free end 6' of the reset arm 6 now bears against the side of the contact arm 1 in the same manner as before the operation of the thermostat. The resetting procedure described above makes the thermostat ready for reuse under exactly the same condition as before the aforesaid operation.

Figure 4:
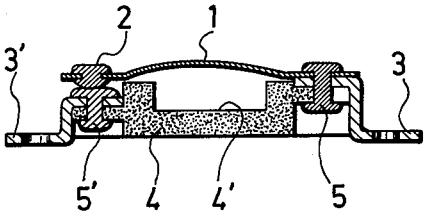
FIG. 4 is a vertical sectional view of an overload-protecting thermostat embodying the invention.

FIG. 4 illustrates an overload-protecting thermostat embodying the invention. This thermostat is similar to the embodiment already described except that the contact arm 1 itself consists of a bimetallic strip. If the current flowing through the arm 1 exceeds the normal value for that circuit, the arm will develop heat by itself and will thereby bend downward to a reversely arcuate shape, bringing the contact 2 at its free end out of contact with the mating clamp 5 and hence breaking the circuit.

Like the first embodiment, this overload-protecting thermostat is provided with a reset arm 6 (not shown), with its free end 6' in pressure contact with the same side of the contact arm 1 as above described. Thus, once the bimetallic contact arm 1 has bent backward, the contact 2 can be held in the open-circuit position. For repeated use of the thermostat it is only necessary to reset the same in the manner already explained.

Figure 5:
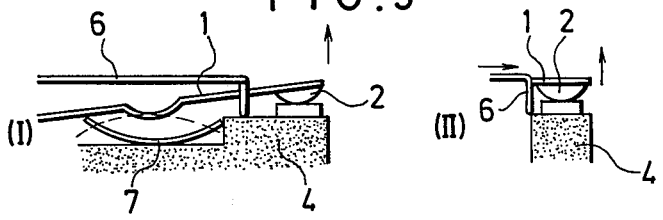
FIGS. 5 through 9 are fragmentary views, partly in section, of other embodiments with reset arms varied in shape and mounting position, each of the figures representing one modification in two elevational views, front (I) and side (II).
Figure 6:
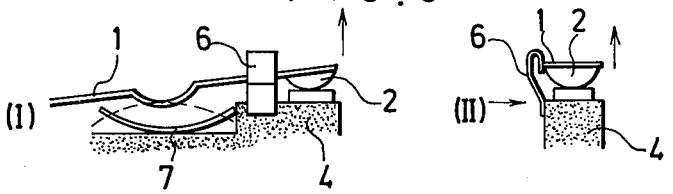
Figure 7:
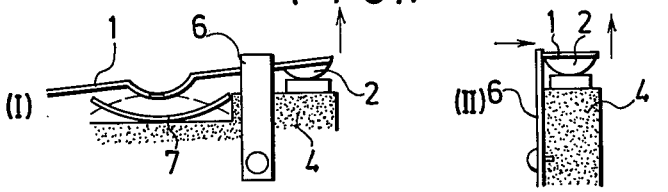
Figure 8:
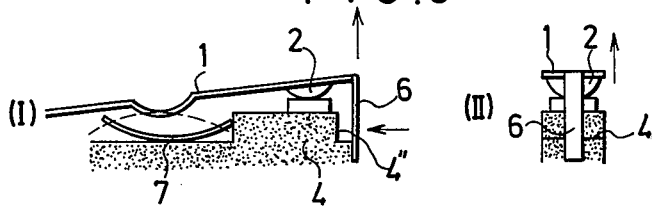
Figure 9:
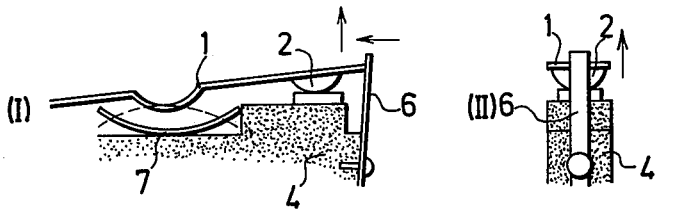

Many different modifications of the reset arm 6, both in shape and mounting position, are within the contemplation of the invention. In FIGS. 5 through 9 there are shown some of such modifications by way of exemplification. FIG. 5 illustrates an inverted-L-shaped reset arm disposed in parallel to a contact arm 1. FIG. 6 shows a reset arm 6 whose upper part is double bent to a hook form and secured at the lower part to the support frame 4. The corresponding arm 6 of FIG. 7 is a flat strip. In FIG. 8 the free end of a contact arm 1 is bent downward so that the bent end portion serves as a reset arm 6. The lower end of this reset arm 6 engages a shoulder 4'' of the support frame 4 when the contact arm 1 is forced upward by the bimetallic action. FIG. 9 shows a reset arm 6 in the form of a flat strip secured at the lower part to one side of the support frame 4 and engaged at the upper end in right-angled relation with the free end of the contact arm 1.

As stated above, the thermostat according to the invention can be repeatedly used by resetting the reset arm, and this eliminates the need for replacing any component after use as is necessary in other safety devices such as current and temperature fuses. Unlike the conventional thermostats of the type, the device of the invention maintains the open-circuit position until the cause for the trouble of the apparatus in which the thermostat is installed has been corrected or removed manually. The thermostat thus provides positive protection against damage. Furthermore, safety to the personnel is ensured because the resetting cannot be performed by anybody other than those quite familiar with the reset mechanism. An additional advantage is the wide temperature setting range and small size made possible by the adoption of a self-resetting bimetal. With these features and advantages the thermostat of the invention has extensive possible applications in various apparatuses, particularly as built-in thermostats for small-size motors and transformers.

What is claimed is:

1. A thermostat comprising: an elongated frame (4) to define a contact zone having a hollow space therein; first and second terminals (3', 3) at each end of said zone; an elongated contact arm (1) stretched across said zone clamped (5) at one end to said first terminal (3), said other end having a contact (2) thereat in opposed relation to said first terminal (3') to make electric contact therewith; a curved bimetal strip (7) extending across said hollow space between said contact arm (1) and said frame (4) biased normally towards said frame but curving against said contact arm (1) and pushing said contact (2) away from said first terminal (3') when heated; a reset arm (6) extending from the vicinity of said second terminal (3) to said first terminal (3') with a flat section disposed alongside said frame (4) and a curved resilient section curved away from said frame (4) but biased to spring towards said frame; and, a flat free end (6') on said reset arm (6) disposed to enter the space between said contact arm (1) and said frame (4) but prevented from so doing by said contact arm being in contact (2) with said first terminal (3') but said free end (6') entering said space when said contact arm (1) is pushed away by said bimetal strip (7), said free end (6') then preventing said contact (2) from again contacting said first terminal (3') until said free end (6') is forcibly removed from the space between the contact arm and the frame.

* * * * *

UNITED STATES PATENT OFFICE

CERTIFICATE OF CORRECTION

Patent No. 4,075,594 Dated February 21, 1978

Inventor(s) Tomoyoshi Uchiya

It is certified that error appears in the above-identified patent and that said Letters Patent are hereby corrected as shown below:

On the title page, item [75], the inventor's name should read --Tomoyoshi Uchiya--.

Signed and Sealed this

Sixteenth Day of May 1978

[SEAL]

Attest:

RUTH C. MASON
Attesting Officer

LUTRELLE F. PARKER
Acting Commissioner of Patents and Trademarks